United States Patent [19]

Watanabe et al.

[11] Patent Number: 4,769,076

[45] Date of Patent: Sep. 6, 1988

[54] BINDERS FOR MANUFACTURE OF PRECISION CASTING MOLDS

[75] Inventors: Yoshitane Watanabe; Akira Kitajima; Keiko Tasaki, all of Funabashi; Isamu Yuuki, Toyota, all of Japan

[73] Assignees: Nissan Chemical Industries, Ltd., Tokyo; Toyota Jidosha Kabushiki Kaisha, Aichi, both of Japan

[21] Appl. No.: 881,274

[22] Filed: Jul. 2, 1986

[30] Foreign Application Priority Data

Jul. 5, 1985 [JP] Japan ..... 60-148820

[51] Int. Cl.[4] ..... B28B 7/28

[52] U.S. Cl. ..... 106/38.35

[58] Field of Search ..... 106/38.3, 38.9, 38.35

[56] References Cited

U.S. PATENT DOCUMENTS

| | | | |
|---|---|---|---|
| 3,314,806 | 4/1967 | Emblem et al. | 106/38.2 |
| 3,894,572 | 7/1975 | Moore | 427/403 |
| 3,920,578 | 11/1975 | Yates | 106/38.3 |
| 4,080,214 | 3/1978 | Wilhelm | 106/38.35 |
| 4,159,204 | 6/1979 | Dittrich et al. | 106/38.35 |
| 4,204,872 | 5/1980 | Hayati et al. | 106/38.35 |
| 4,211,567 | 7/1980 | Dittrich et al. | 106/38.35 |
| 4,396,430 | 8/1983 | Matalon | 106/38.3 |
| 4,522,958 | 6/1985 | Das et al. | 524/502 |

*Primary Examiner*—Theodore Morris

*Attorney, Agent, or Firm*—Parkhurst & Oliff

[57] ABSTRACT

Binders for manufacture of precision casting molds are provided, which are highly stable and are advantageous in that these may impart a high strength to the green molds as obtained by forming an accumulative refractory coat layer on a water-soluble pattern and then taking off the pattern from the coat layer, that no interlayer cleavage occurs in the accumulative coat layer when the pattern is taken off in the formation of the green mold, that the binders may impart a high strength to fired molds, that the castings as obtained by the use of the present fired molds are free from the surface roughness and other surface faults and that the dimension accuracy of the castings is not deteriorated at all by the use of the present binders.

The binders of the present invention are characterized by containing the following components (a), (b) and (c) and optionally (d):

(a) an organo-silicasol capable of providing 5–50 parts by weight of $SiO_2$ in the binder;

(b) 1–50 parts by weight of an alkyl silicate, an alkoxy-organosilane or a mixture thereof in the binder;

(c) 1–30 parts by weight of a binder-soluble amine in the binder;

(d) 1–30 parts by weight of an alkoxide of Ti, Zr, Sn, Al or In or a mixture thereof in the binder.

18 Claims, No Drawings

BINDERS FOR MANUFACTURE OF PRECISION CASTING MOLDS

BACKGROUND OF THE INVENTION

The present invention relates to the improvement of binders for the formation of a coat layer, which are used in the method for the manufacture of molds where a refractory coat layer is formed on a mold pattern (hereinafter referred to as "pattern") and thereafter the pattern is taken off and the refractory layer is fired to obtain a desired mold.

In general, the refractory coat layer is formed on a pattern as an accumulative structure by repeating a procedure comprising coating said pattern with a liquid binder or a mixture slurry comprising the liquid binder and a refractory powder, sanding, if desired, drying and hardening the thus obtained coated layer, until a desired thickness is obtained for an accumulative layer.

One of the remarkable improvements in the precision casting technique where the molds as obtained by the formation of the said refractory coat layer on the pattern are used was the improvement of binders for molds, and the other was the improvement of pattern materials.

The improvement of the pattern materials has been developed mainly for the purpose of the improvement of the moldability, dimension stability and strength or of the reduction of the cost; and for example, blends of various kinds of waxes or waxes as improved by the addition of a flux as well as improved materials of naphthalens, plastics or ureas have heretofore been proposed. In particular, urea-type materials are water-soluble and have both high strength and high dimension stability and furter are inexpensive, and therefore, a lot of these materials have been used as these are almost satisfactory materials, although some careful attention is to be paid to the moisture in air in the treatment of the materials.

On the other hand, numerous kinds of proposals for the improvement of the binders have heretofore been made, but no sufficient improvement has been attained as yet, up to the present. In the initial stage, aqueous silicasols, alcohol silicasols or ethyl silicates have been used. However, when kept in contact with water-soluble patterns, the aqueous silicasols corrode the surface of the patterns. Regarding the alcohol silicasols, any high strength cannot be imparted to the green molds before fired, and the molds are apt to be broken in the operation for the removal of patterns. The ethyl silicates cannot form fired molds of high strength. In addition, the binders obtained by the hydrolysis of the ethyl silicates are poorly stable, and therefore, it is difficult to manufacture molds of a certain quality from these binders.

Japanese Patent Publication No. 32482/73 has proposed a binder which contains a colloidal silica and a hydrolyzed alkyl silicate and which is free from water, by blending an alkyl silicate and an appropriate amount of an aqueous silicasol. This binder, however, is not so stable as being able to be preserved for a long period of time, and further, when kept in contact with the surface of a pattern made of a water-soluble material, this corrodes the surface of the pattern.

Japanese Patent Publication No. 40366/79 has proposed a binder with an improved stability, which comprises a colloidal silicasol, a hydrolyzed alkyl silicate and a glycolether as blended in an appropriate proportion. However, this binder is also unfavorable, since this dissolves the surface of the pattern made of a water-soluble material, when kept in contact therewith.

Japanese Patent Publication No. 22929/79 has proposed still another improved binder, which comprises 30–60% of a nethyl silicate mixture comprising various polyethyl silicates, 20–50% of an anhydrous solvent having a dipole moment of 1 Debye or less and 8–30% of an amino group-containing organic functional hydrophilic silicon compound. However, the binder of this kind still is insufficient in view of the fact that a higher precision is desired at present in the field of the precision casting technique. This is especially because, when a mold manufactured by the use of this binder is used for casting, the surface of the casting is made rough. Further, in the step for the formatio of the green mold, interlaminar cleavage is apt to occur in the accumulative coat layer, and if the mold with such interlaminer cleavage is used in casting, the mold is often broken when a molten metal is put thereinto. Thus, the use of this binder causes various unfavorable results.

The difficulty in the improvement of binders for the manufacture of precision casting molds results from the difficulty in the discovery of such binders as being able to satisfy all the subject matters that no problem occur in the step of coating a binder slurry on a water-soluble pattern of high strength and high dimension accuracy, the step of drying the coat layer, the step of removing the pattern from the coat layer, the step of firing the coat layer and other various steps, that the binder itself has a sufficient stability and thus molds of a certain characteristic may easily be obtained with the binder and that the molds after fired have no defects.

SUMMARY OF THE INVENTION

The object of the present invention is to provide binders for manufacture of precision casting molds, which are highly stable and are advantageous in that these may impart a high strength to the green molds as obtained by forming an accumulative refractory coat layer on a water-soluble pattern and then taking off the pattern from the coat layer, that no interlaminar cleavage occurs in the accumulative coat layer when the pattern is taken off in the formation of the green mold, that the binders may impart a high strength to fired molds, that the castings as obtained by the use of the said fired molds are free from the surface roughness and other surface faults and that the dimension accuracy of the castings is not deteriorated by the use of the present binders.

DESCRIPTION OF THE PREFERRED EMBODIMENT

The binders for manufacture of precision casting molds, according to the present invention, are characterized by containing the following components (a), (b) and (c) and optionally (d):

(a): 5–50 parts by weight (in terms of $SiO_2$) of an organo-silicasol;

(b): 1–50 parts by weight of an alkyl silicate, an alkyl polysilicate having a polymerization degree of 2–10, an alkyl-trialkoxysilane, an aryl-trialkoxysilane (in which the alkyl group and the alkoxy group each have 1–carbon atoms; the aryl group has 6–8 carbon atoms; and any of the alkyl group, the alkoxy group and the aryl group do not have an amino group) or a mixture thereof;

(c) 1–30 parts by weight of a binder-soluble amine;

(d): 1–30 parts by weight of an alkoxide of Ti, Zr, Sn, Al or In (in which the alkoxy group has 1–4 carbon atoms) or a mixture thereof in the binder.

The organo-silicasol to be used in the binder of the present invention is a dispersion of a surface silanol group-containing colloidal silica having an average particle size of 5–100 mμ as stably dispersed in an organic solvent. The $SiO_2$ concentration in the organo-silicasol is preferably 5–60% by weight or so. Examples of preferred organic solvents are aliphatic hydrocarbons such as hexane or heptane, aromatic hydrocarbons such as toluene or xylene, and other alcohols and ethers. In particular, in case a water-soluble pattern is used, the sols of the aforementioned hydrocarbon solvents are preferred. The usable organosols preferably have a low water-content, which is generally 5% by weight or less, especially preferably 1% by weight or less. The organo-silicasols may easily be obtained in a conventional manner, for example, by a method where water of a dispersion medium in an aqueous silicasol is substituted by a hydrophilic solvent by distillation or a method where the solvent as substituted in the former method is further substituted by a hydrophobic solvent or a hydrocarbon solvent by distillation.

The alkyl silicate to be used in the binder of the present invention is an alkyl ester of silicic acid or poly-silicic acid having a polymerization degree of 2–10 or so or a mixture thereof. Examples of the alkyl are methyl, ethyl, propyl and butyl. Preferred examples of the alkyl silicates are ethyl silicate and isopropyl silicate. For the ethyl silicate may be used a commercial product of "Ethyl Silicate 40" ®.

The alkoxy-organosilane to be used in the binder of the present invention has a structure of the afore-mentioned alkyl silicate molecule in which one alkoxy group per one silicon atom is substituted by a substituted or unsubstituted hydrocarbon group. Examples thereof are methyltriethoxysilane, ethyltrimethoxysilane and phenyltrimethoxysilane. The binder-soluble amine to be used in the binder of the present invention is compound containing one or more of basic nitrogen atoms in the molecule. The examples of these amines are piperidine, benzylamine, dibutylamine, morpholine, alkanolamines such as ethanolamine, N-methylethanolamine, dimethylethanolamine, aminoethylethanolamine, diethylene-ethanoldiamine, diethanolamine, aminoethyl-diethanolamine, tert-butyleneglycolamine, triethanolamine, γ-(2-aminoethyl) aminopropyltrimethoxysilane, γ-aminopropyl-triethoxysilane, bis [3-(triethoxysilyl)propyl]amine.

Examples of the alkoxides of Ti, Zr, Sn, Al or In to be used in the binder of the present invention are titanium tetraisopropoxide, zirconium tetraisopropoxide, tin tetrabutoxide, aluminium triisopropoxide and indium tributoxide.

These alkoxy-organosilanes, soluble amines and alkoxides of Ti, Zr, Sn, Al or In are easily available as commercial products. The binder of the present invention comprises an organo-silicasol as the component (a), an alkyl silicate, an alkoxy-organosilane or a mixture thereof as the component (b) and a soluble amine as the component (c) and an alkoxide of Ti, Zr, Sn, Al or In as the optional compondnt (d), and the proportion of each component in the binder is 5–50 parts by weight of $SiO_2$ of the component (a), 1–50 parts by weight of the component (b) and 1–30 parts by weight of the component (c) and optionally 1–30 parts by weight of the component (d). The present binder may easily be obtained by uniformly blending these components. In a special case where an amino group- or imino group-containing alkoxy-organosilane is used as the component (c), the component (b) may be omitted. No heating is required in the admixture of the above-described components, and it is preferred to blend the components in the absence of water. In addition to the above-described components, any optional additives such as water-repellent agent, anti-foaming agent, coloring agent and solvent may be added to the binder of the present invention, so far as the object of the present invention may be attained. Usable solvents are those which may uniformly dissolve in the solvents of the organo-silicasols and which may dissolve alkyl silicates, alkyl polysilicates, alkyl-trialkoxysilanes, aryl-trialkoxysilanes, amines and alkoxides of Ti, Zr, Sn, Al or In; and examples thereof are hexane, heptane, toluene, xylene, alcohol and ether.

The hardening of the binder of the present invention is caused by absorption of water and removal of the solvent, whereby a strong binding strength is imparted to the green mold and the mold becomes to have a higher strength after fired.

The binder of the present invention is a composition comprising the afore-mentioned components (a), (b) and (c) in a specifically defined proportion or a composition comprising these components and additionally the component (d) in a specifically defined proportion; and the present binder may display an extremely favorable effect in the manufacture of casting molds, especially in the hydrolysis or drying step as well as in the firing step, on the basis of the synergestic effect of the afore-mentioned components.

The component (a) in the binder of the present invention is effective for imparting a high strength to the fired mold, and in particular, this may impart an extremely high strength to the mold while hot during the pouring of a molten metal thereinto, this may improve the hardness and the fineness of the surface of the mold which is to be kept in contact with the molten metal, and further, this is effective for preventing the occurrence of fine cracks in the coat layer during the step for the formation of the coat layer on the water-soluble pattern, especially during the step of drying the layer. However, such binder as comprising only the component (a) or a mixture of the component (a) and the component (c) which is selected from other amines than alkoxy-organosilanes having an amino group or an imino group in the molecule, such as piperidine, cannot impart a high strength to the green mold. Further, a favorable drying of the coat layer is difficult by the use of the binder comprising a composition of the components (a) and (b) only, because of the slow hydrolysis of the binder.

In the binder of the present invention, the component (b) is effective for imparting a high strength in the dry coat layer as formed on the pattern, whereby the breakage of the layer during the removal of the pattern therefrom may be prevented and also the breakage of the resulting green mold during the handling operation thereof may be prevented. However, the binder comprising the component (b) only is unfavorable because of the slow hydrolysis thereof; and the binder comprising a mixture of the component (b) and the component (c) which is selected from other amines than amino group- or imino group-containing organo-alkoxysilanes, such as piperidine, cannot impart a high strength to both the green mold and the fired mold.

In the binder of the present invention, the component (c) is effective for accelerating the hydrolysis of the component (b) and further, when the present binder is dried in the coat layer, this may act to accelerate the synergestic bond due to composite of the components (a) and (b) whereby a favorable hardened body may be formed. In addition, the binder which has been made specially uniform by the addition of the binder-soluble component (c) may uniformly harden, whereby the occurrence of local strength faults in the mold may be prevented. However, such binder as consisting of only the component (c), which is selected from amino group- or imino group-containing alkoxy-organosilanes, cannot impart a high strength to the fired mold; and the single component (c) other than the afore-mentioned alkoxy-organosilanes, such as piperidine, has no bindability. When an amino group- or imino group-containing alkoxy -organisilane is used as the component (c), this may co-operate with the component (a) to display the favorable bindability in the binder because of the hydrolytic bindance of the said component (c) itself. In a special case, a favorable binder may be obtained even if the component (b) is omitted.

In the binder of the present invention, the component (d) is effective for retarding the gelling of the coat layer containing the present binder, when the coat layer is dried, and for preventing the probable occurrence of fine cracks during the drying step, and thus, more preferable green molds and fired molds having a sufficient strength may be obtained by the use of the binder containing the additional component (d). However, the component (d) itself cannot form a film but is easy to become powdery, when hydrolyzed and then dried and hardened; and this per se does not have any favorable bindability. Accordingly, such binder as containing only the component (d) but not containing the afore-mentioned components (a), (b) and (c) does not have a favorable characteristic.

In the binder containing the afore-mentioned components (a), (b) and (c) and optionally the component (d), if the content ratio of the component (a) is too high, as providing more than 50 parts by weight of $SiO_2$ in the binder, the stability of the binder becomes poor; but on the contrary, if the content ratio is too small, as providing less than 5 parts by weight of $SiO_2$ in the binder, the effect of the binder of the present invention, as mentioned in the above, cannot be attained. Regarding the component (b), the high content ratio thereof, as exceeding 50 parts by weight, will result in the relative reduction of the content ratio of the component (a); but on the contrary, if the content ratio is less than 1 part by weight, the characteristic of the resulting binder will become poor. Regarding the component (c), if the content ratio is less than 1 part by weight, the afore-mentioned effect of the component (c) will become insufficient; but on the contrary, the higher content ratio thereof, as exceeding 30 parts by weight, will result in the relative reduction of the content ratio of each of the components (a) and (b) and therefore is unfavorable. Regarding the component (d), the content ratio thereof is properly 1–30 parts by weight in order to impart the favorable characteristic to the binder.

As noted from the above description, the binder of the present invention is characterized by containing the component (a) in an amount capable of providing 5–50 parts by weight of $SiO_2$ in the binder, the component (b) in the amount of 1–50 parts by weight and the component (c) in an amount of 1–30 parts by weight or by further containing, in addition to these components, the component (d) in an amount of 1–30 parts by weight.

When a conventional binder, for example, comprising 30–60% of ethyl silicate, 20–50% of xylene and 8–30% of $\gamma$-aminopropyltriethoxysilane is used to form a coat layer on a pattern made of a water-soluble material and another coat layer containing a binder of an aqueous silicasol is superposed thereover and dried, needle-like or feather-like crystals appear on the surface of the coat layer; and if the fired mold prepared from the coat layer having such crystals on the surface thereof is used for actual casting, the surface of the obtained castings will be rough. The appearance of the afore-mentioned crystals is considered to result from the phenomena that moisture reaches the surface of the pattern through the coat layer and dissolve the said surface, and, when the solvent in the coat layer is removed out by drying, the component dissolved out from the surface of the pattern is together moved up onto the surface of the coat layer and the dissolved component crystallizes out on the said surface. Accordingly, the appearance of the aforementioned crystals on the coat layer after dried means that the surface of the green mold before fired, which has the coat layer formed by the use of the conventional binder as mentioned above, already involves the cause of the occurrence of the surface roughness and that the strength of the mold is lowered. Further, the appearance of the afore-mentioned crystals on the surface of the coat layer means that the coat layer formed by the use of the said conventional binder is highly water-permeable.

On the contrary, when the binder of the present invention, which comprises the afore-mentioned components, is used, in particular, when the binder of the present invention, which contain a hydrocarbon solvent-silicasol as the component (a), is used, any crystals as mentioned above do not appear at all on the surface of the coat layer as formed on a water-soluble pattern. Further, when a fired mold obtained from the coat layer is used for actual casting, no roughness occurs on the surface of the formed castings. The binder of the present invention is highly stable, as comprising the afore-mentioned components in a specifically determined proportion, and further, this may rapidly harden during the drying of the coat layer. The binders of the present invention have no problem at all in all of the step for the formation of the coat layer on a pattern, the step of drying, the step of removal of the pattern, the step of drying, the green mold, the step of firing and the step of pouring a molten metal, and therefore a complete precision casting is possible with the mold formed by the use of the binder of the present invention.

The present invention will be explained in greater detail be reference to the following examples, which, however, are not intended to be interpreted as limiting the scope of the present invention.

EXAMPLE 1

800 parts by weight of xylene-silicasol containing 23% by weight of $SiO_2$ as dispersed in a dispersion medium of xylene, as an organo-silicasol, 160 parts by weight of methyl triethoxysilane and 40 parts by weight of piperidine were uniformly blended to obtain a binder (A).

The binder (A) was coated on a glass plate and dried, while left in air of a temperature of 25° C. and a relative humidity of 50% for 25 minutes, whereby a hardly gelled, glossy and transparent film was formed on the glass plate.

5000 parts by weight of Zircon Flower #350 ® was added to 1000 parts by weight of the binder (A) and blended to obtain a slurry ($A_1$), and in the same manner, 4800 parts by weight of Zircon Flower #200 ® was added to 1000 parts by weight of the binder (A) and blended to obtain a slurry ($A_2$), respectively. On the other hand, a water-soluble urea powder was heated and molten at 150°–170° C. and poured into a mold to form a water-soluble pattern having a width of 20 mm, a length of 100 mm and a thickness of 10 mm. Next, stucco materials for sanding were prepared. In the first place, the pattern was dipped in the slurry ($A_1$) and then taken out therefrom to form a first coat layer, which was sanded and thereafter dried; and then, the pattern with the first coat layer was dipped in the slurry ($A_2$) and then taken out therefrom to form a second layer thereon, which was sanded and thereafter dried. In the same manner, 3rd to 6th coat layers were formed by the use of the slurry ($A_2$), as accumulated in order. In the last place, a 7th layer was formed by dipping in the slurry ($A_2$). This 7th layer was not sanded and dried directly after the dipping. Thus, an accumulative coat layer was formed on the pattern. The stucco materials as used in the sanding as well as the drying conditions in the formation of the afore-mentioned accumulative coat layer are given in the following Table-1.

TABLE-1

| Number of Accumulative Layer | Stucco Material | Drying condition Temperature (°C.) | Relative humidity (%) | Time (hr.) |
|---|---|---|---|---|
| 1 | Zircon Sand #80 ® | 25 | 50 | 3 |
| 2 | Zircon Sand #80 ® | 25 | 50 | 3 |
| 3 | High alumina sand (particle size: 0.5 mm) | 25 | 50 | 3 |
| 4 | High alumina sand (particle size: 0.5 mm) | 25 | 50 | 3 |
| 5 | High alumina sand (particle size: 0.5 mm) | 25 | 50 | 3 |
| 6 | High alumina sand (particle size: 0.5 mm) | 25 | 50 | 3 |
| 7 | None | 25 | 50 | 48 |

The formation of the above accumulative coat layer was repeated for 20 times, and the reproducibility was extremely good in every case. The pattern as coated with the coat layer formed above was dipped in water at 25° C. for 120 minutes, whereby the pattern easily dissolved out, and the hardened product made of the accumulative coat layer was taken out from water and dried at room temperature, to easily obtain a green mold.

Next, the green mold was cut with a diamond cutter to obtain ten test pieces therefrom. Five pieces among them were used for the measurement of the strength of the green mold in the bending strength test; and the remaining five pieces were fired in an electric furnace at 1000° C. for 1 hour and then left cooled to ambient temperature. The latter pieces were used for the measurement of the strength of the fired mold in a bending strength test.

As the result of the measurement, the bending strength of the green mold was 28.6 kg/cm$^2$ in average; and the bending strength of the fired mold was 55.4 kg/cm$^2$ in average.

EXAMPLE 2 AND COMPARATIVE EXAMPLE 1

In the same manner as the Example 1, binders (B) through (H) each comprising the following composition were obtained. The binders (B) through (F) are the samples of the present invention; and the binders (G) and (H) are comparative samples. The binder (G) is a hydrolyzed ethyl silicate.

| | | |
|---|---|---|
| (B) | Xylene-silicasol ($SiO_2$ 23%) | 700 parts by weight |
| | τ-(2-aminoethyl)aminopropyl-trimethoxysilane | 200 parts by weight |
| | Isopropyl ortho-titanate | 100 parts by weight |
| (C) | Xylene-silicasol ($SiO_2$ 23%) | 800 parts by weight |
| | τ-Aminopropyltriethoxysilane | 200 parts by weight |
| (D) | Xylene-silicasol ($SiO_2$ 21%) | 560 parts by weight |
| | N—methylethanolamine | 20 parts by weight |
| | Ethyl silicate 40 | 200 parts by weight |
| | Toluene | 170 parts by weight |
| | Isopropyl ortho-titanate | 50 parts by weight |
| (E) | Xylene-silicasol ($SiO_2$ 17%) | 615 parts by weight |
| | Benzylamine | 30 parts by weight |
| | Ethyl silicate 40 | 250 parts by weight |
| | Tin tetrabutoxide | 105 parts by weight |
| (F) | n-butanol-silicasol ($SiO_2$ 25%) | 800 parts by weight |
| | Methyl-triethoxysilane | 160 parts by weight |
| | Piperidine | 40 parts by weight |
| (G) | Ethyl silicate 40 | 748 parts by weight |
| | Ethanol | 183 parts by weight |
| | 0.4%-hydrochloric acid | 69 parts by weight |
| (H) | Ethyl silicate 40 | 441 parts by weight |
| | Xylene | 353 parts by weight |
| | Isopropyl ortho-titanate | 103 parts by weight |
| | τ-aminopropyl-triethoxysilane | 103 parts by weight |

Next, in the same manner as the Example 1, 5000 parts by weight of Zircon Flower #350 ® was added to 1000 parts by weight of each of these binders (B) through (H) to obtain slurries of ($B_1$) through ($H_1$), respectively; and 4800 parts by weight of Zircon Flower #200 ® was added to 1000 parts of each of the binders (B) through (H) to obtain slurries of ($B_2$) through ($H_2$). Next, in the same manner as Example 1, an accumulative coat layer was formed on the same water-soluble pattern as the Example 1, where the corresponding two kinds of slurries each containing the same binder were used and the sanding condition was same as the Example 1, as described in the Table 1. The samples each using the binders (B) through (G) were good, as the reproducibility was good and no problem occurred in the removal of the pattern, and thus, good green molds were obtained. However, the green mold obtained by the use of the binder (H) was poor because the interlaminar cleavage occurred between the first coat layer and the second coat layer in a proportion of 15%.

Further, in the same manner as the Example 1, test pieces for the measurement of the bending strength were obtained from the green molds, and the bending strength of the green molds was tested. After fired, the bending strength of the fired molds was also tested. The results are given in the following Table-2:

TABLE-2

| Group | Binder as used | Bending strength of green mold (kg/cm$^2$) | Bending Strength of fired mold (kg/cm$^2$) |
|---|---|---|---|
| Present sample | (B) | 39.8 | 50.9 |
| Present | (C) | 28.2 | 54.1 |

TABLE-2-continued

| Group | Binder as used | Bending strength of green mold (kg/cm$^2$) | Bending Strength of fired mold (kg/cm$^2$) |
|---|---|---|---|
| sample | | | |
| Present sample | (D) | 36.5 | 54.5 |
| Present sample | (E) | 32.8 | 62.4 |
| Present sample | (F) | 29.3 | 56.2 |
| Comparative sample | (G) | 26.6 | 25.1 |
| Comparative sample | (H) | 33.8 | 42.1 |

Analogously to the results of the afore-mentioned Example 1, it is noted that the fired molds obtained by the use of the binders of the present invention have an extremely higher bending strength than those obtained by the use of the comparative binders.

EXAMPLE 3

A binder (J) of an aqueous solicasol containing 30% by weight of $SiO_2$ was prepared, and 1000 parts by weight of the binder, 3500 parts by weight of Zircon Flower #200®, 0.3 part by weight of a surfactant and 0.03 part by weight of an anti-foaming agent were uniformly blended to obtain a slurry ($J_1$). Apart from this, the same water-soluble pattern was formed as the Example 1.

Next, the slurry ($A_1$) of the Example 1 was used, and the above water-soluble pattern was dipped therein. After taken out therefrom, the coat surface was sanded with a stucco material of Zircon Sand #80® and then dried in air of temperature of 25° C. and a relative humidity of 50% for 3 hours, to obtain a first coat layer on the water-soluble pattern. Subsequently, the pattern with the first coat layer was dipped in the slurry ($J_1$) and then taken out therefrom to form a second coat layer, which was sanded with the same stucco material as above and then dried under the same drying condition as above. Next, a third layer was formed on the second layer, by dipping in the slurry ($J_1$). After taken out from the slurry ($J_1$), the surface of the third layer was sanded with a stucco material of chamotte sand having a particle size of 0.5 mm and then dried in air of a temperature of 25° C. and a relative humidity of 50% for 24 hours. Thus a three layer-accumulative coat was formed on the water-soluble urea pattern.

About ⅔ of the part of the coat layer of the pattern was dipped in water at 25° C. for 10 minutes while the part of the pattern body was kept out of contact with water, and thereafter the pattern was taken out from water and dried in air at normal temperature for 48 hours. After being dried, the appearance of the surface of the coat layer was observed, with the result that no crystals were found therein. It is apparent therefrom that the water-proofness of the first coat layer is extremely excellent.

On the other hand, all of the coated pattern was wholly dipped in water at 25° C. for 30 minutes, whereby the pattern dissolved out. Next, a hardened body made of the accumulative coat layer was taken out from the water and dried in air at room temperature for 48 hours, to obtain a green mold. The green mold was broken and the state of the surface which had been kept in contact with the pattern before the removal thereof and the state of the opposite surface thereof, i.e., the third coat layer were observed with the naked eye, with the result that all the surfaces as observed were considered uniform and free from surface faults. Further, it was noted as a result of a hand-touch test, the hardness of the surface of the green mold which had been kept in contact with the pattern was sufficiently high.

EXAMPLE 4 AND COMPARATIVE EXAMPLE 2

In the same manner as the Example 3, with the exception that the slurries ($B_1$) through ($H_1$) as prepared in the above Example 2 and Comparative Example 1 were used in place of the slurries in the Example 3, a three-layer accumulative coat layer was formed on the water-soluble urea pattern. The samples made by the use of the slurries ($B_1$) through ($F_1$) belong to Example 4; and those made by the use of the slurries ($G_1$) and ($H_1$) belong to Comparative Example 2. The surface of the coat layer as formed on the pattern was observed in every sample, as to whether or not crystals occurred thereon, in the same manner as the Example 3, with the result that all the samples made by the use of the slurries ($B_1$) through ($F_1$) were free from crystals. However, the crystals occurred on the surface of both samples made by the use of the slurries ($G_1$) and ($H_1$), and these samples were considered poor in the water-proofness.

Next, green molds were obtained from the samples of the accumulative coat layers as above, in the same manner as the Example 3, and these were broken and the hardness and the characteristic of the surface of the coat layer which had been kept in contact with the pattern were observed. As a result, it was noted that the surface hardness was high in every sample where the slurry selected from ($B_1$) through ($F_1$) was used and further, all of these samples were free from surface faults; whereas the surface of the sample obtained by the use of the slurry ($G_1$) was soft and is lacking in the uniformity. In the sample made by the use of the slurry ($H_1$), the surface thereof was soft and the hardness thereof was insufficient, though the surface faults were not seen thereon.

The samples of the Comparative Example 2 and those of the Example 4 were compared with each other, which proved that the water-proofness of the first coat layer as kept in contact with the water-soluble pattern was extremely improved by the use of the binder of the present invention. Thus, an accumulative coat layer formed by the use of an aqueous silicasol binder may be provided on the said first coat layer to obtain a mold, which may be used in precision casting.

EXAMPLE 5

A water-soluble urea powder was molded in a mold at a temperature of 130°–140° C. and under a pressure of 150 kg/cm$^2$, to obtain a water-soluble pattern, and this was combined with other pattern parts of runner and gate, which were separately formed from a water-soluble wax, with an adhesive, to obtain a tree. This tree was dipped in the slurry ($C_1$) as prepared in the afore-mentioned Example 2 and then taken out therefrom. This was sanded with a stucco material of Zircon Sand #80® and then dried in air of a temperature of 25° C. and relative humidity of 50% for 3 hours, to form a first coat layer on the tree. Subsequently, the tree with the first coat layer was dipped in the slurry ($J_1$) as prepared in the Example 3 and then taken out thereform. This was sanded and dried in the same manner as above, to form a second coat layer on the first coat layer. Next, 3rd to 7th layers were formed thereon in order, by the use of the slurry ($J_1$). The drying condition was same as above in every operation, with the exception that the drying time for the formation of the 7th layer was 48 hours. Regarding the stucco materials as used in the sanding, chamotte sands having a particle size of 0.5 mm were used for the formation of the 3rd and 4th coat layers; chamotte sands having a particle size of 1.0 mm were used for the formation of the 5th and 6th coat layers; and no sanding was carried out in the formation of the 7th layer but the 7th layer was merely dried. The surface of the coat layer as provided on the pattern was free from crystals as mentioned above.

The tree as coated according to the above process was dipped in a boiling water for 15 minutes to remove the pattern therefrom, and the hardened article made of the accumulative coat layer was taken out from the water and dried in air of a temperature of 100° C. for 1 hour to obtain a green mold. The inner surface of the green mold had a sufficient hardness and no surface roughness was noted at all in the said surface. Next, this green mold was fired in an electric furnace at 1000° C. for 2 hours to obtain a fired mold, which was also quite free from any faults at all.

Next, a molten metal of JIS SCS 13 (at 1650° C.) was poured into the fired mold and then spontaneously cooled. After being cooled, the mold was broken to obtain a casting. This casting had a high surface smoothness and a high dimensional accuracy.

EXAMPLE 6 AND COMPARATIVE EXAMPLE 3

In the same manner as the Example 5, with the exception that the slurries ($D_1$) and ($E_1$) as prepared in the Example 2 as well as the slurries ($G_1$) and ($H_1$) as prepared in the Comparative Example 1 were used instead of the slurry ($C_1$), coated patterns, green molds and fired molds were formed, and then the casting test was carried out in each sample.

As a result, the sample obtained by the use of the slurries ($D_1$) and ($E_1$) was quite good analogously to the sample of the Example 5; while in the coated pattern as formed by the use of the slurries ($G_1$) and ($H_1$), the afore-mentioned crystals occurred on the surface of the coat layer, and the surface of the casting as obtained by the use of the fired mold was noted remarkably rough. In the result of the repeat-test, the reproducibility was good in the case where the slurries ($D_1$) and ($E_1$) were used. However, in the other case where the slurry ($G_1$) was used, one of ten fired molds in all was broken while a molten metal was poured thereinto.

The effect of the present invention will be summarized below. The binders of the present invention are extremely stable, and almost no deterioation is recognized after the binder has been preserved for a long period of time of 6 months or more under a water-free condition. By the use of the present binder, molds of a certain quality may be obtained with high reproducibility. In particular, when a slurry containing the present binder is coated on a water-soluble pattern, especially a water-soluble urea pattern, and the coated pattern is dried in a moisture-containing air, any needle-like or feather-like crystals which will result from the dissolution of urea from the pattern do not occur on the surface of the coat layer. The use of the binder of the present invention is effective for intensifying the strength of the mold, especially the fired mold, and a complete precision casting is possible by the use of the present mold.

Further, the coat layer formed by the use of the present binder is, after dried, almost non-water permeable. Therefore, when a first coat layer is once formed on a water-soluble pattern by the use of the binder of the present invention, any conventional binder such as an aqueous silicasol may be used in the formation of the upper layers thereover to form an accumulative coat layer, and the mold derived from the accumulative coat layer does not cause the occurrence of the surface roughness of the casting obtained by the use of the said mold. The use of the aqueous silicasol is favorable for the manufacture of molds having high strength, and further, the cost for the manufacture of the molds may be reduced.

In case the binder of the present invention is used, no problem occurs in all of the steps of forming an accumulative coat layer on a water-soluble pattern, the step of removing the pattern, the step of drying the coat layer to form a green mold, the step of firing the green mold and the step of pouring a molten metal into the fired mold, which results from the surprising characteristic of the binder of the present invention. The binders of the present invention may be applied not only to a water-soluble urea-type pattern but also to other water-soluble patterns of a water-soluble flux or to other water-insoluble patterns, for the manufacture of molds.

What is claimed is:

1. A binder composition for making a ceramic shell mold for an extremely precise investment casting of metals by forming a layer containing said binder and a refractory material on and in contact with a water soluble urea pattern, drying said layer in air during which said binder is hardened through absorption of water from the air and evaporation of solvent in the binder, removing said pattern from said layer by dissolving the pattern with water, again drying said layer, and finally firing said layer, comprising a uniform mixture of (a) 5–50 parts by weight as $SiO_2$ of an organo-silica sol which contains not more than 1% by weight of water and consists essentially of 5–60% by weight based on said sol of colloidal silica having a particle size of 5–100 mμ and residual amounts of an organic solvent selected from a group consisting of aliphatic and aromatic hydrocarbons having 6–8 carbon atoms in the molecule, aliphatic monohydric alcohols having 3–6 carbon atoms in the molecule or mixtures thereof;

(b) 1–50 parts by weight of an alkyl silicate, an alkyl polysilicate having a degree of polymerization 2–10, an alkyltrialkoxysilane, an aryltrialkoxysilane or mixtures thereof, wherein the alkyl group and the alkoxy group each have 1–4 carbon atoms, the aryl group has 6–8 carbon atoms, and the alkyl group, the alkoxy group and the aryl group do not have an amino group;

(c) 1–30 parts by weight of a binder-soluble amine.

2. The binder composition for a mold as claimed in claim 1, wherein the organic solvent in the organo-silica sol is hexane, heptane, benzene, xylene, toluene, propanol, butanol or a uniform solution thereof.

3. The binder composition for a mold as claimed in claim 1, wherein the alkyl silicate is ethyl silicate or isopropyl silicate.

4. The binder composition for a mold as claimed in claim 1, wherein the alkyl poly-silicate is ethyl poly-silicate or isopropyl poly-silicate.

5. The binder composition for a mold as claimed in claim 1, wherein the amine is piperidine, benzylamine, dibutylamine, morpholine, ethanolamine, N-methylethanolamine, dimethylethanolamine, aminoethylethanolamine, aminoethyldiethanolamine, diethyleneethanoldiamine, diethanolamine, tert-butylene glycolamine, triethanolamine, γ-(2-aminoethyl)aminopropyltrimethoxysilane, γ-aminopropyltriethoxysilane or bis [3-(triethoxysilyl)-propyl]amine.

6. A binder composition for making a ceramic shell mold for an extremely precise investment casting of metals by forming a layer containing said binder and a refractory material on and in contact with a water soluble urea pattern, drying said layer in air during which said binder is hardened through absorption of water from the air and evaporation of solvent in the binder, removing said pattern from said layer by dissolving the pattern with water, again drying said layer, and finally firing said layer, comprising a uniform mixture of (a) 5–50 parts by weight as $SiO_2$ of an organo-silica sol which contains not more than 1% by weight of water and consists essentially of 5–60% by weight based on said sol of colloidal silica having a particle size of 5–100 mμ and residual amounts of an organic solvent selected from a group consisting of aliphatic and aromatic hydrocarbons having 6–8 carbon atoms in the molecule, aliphatic monohydric alcohols having 3–6 carbon atoms in the molecule and mixtures thereof, (b) 1–50 parts by weight of an alkyl silicate, an alkyl polysilicate having a degree of polymerization of 2–10, an alkyl trialkoxysilane, an aryltrialkoxysilane or mixtures thereof, wherein the alkyl group and the alkoxy group each have 1–4 carbon atoms, the aryl group has 6–8 carbon atoms, and the alkyl group, the alkoxy group and the aryl group do not have an amino group;

(c) 1–30 parts by weight of a binder-soluble amine, and (d) 1–30 parts by weight of a tetra-alkoxide of Ti, Zr or Sn or a tri-alkoxide of Al or In, wherein the alkoxy group has 1–4 carbon atoms, or a mixture thereof.

7. The binder composition for a mold as claimed in claim 6, wherein the organic solvent in the organo silica sol is hexane, heptane, benzene, xylene, toluene, propanol, butanol or a uniform solution thereof.

8. The binder composition for a mold as claimed in claim 6, wherein the alkyl silicate is ethyl silicate or isopropyl silicate.

9. The binder composition for a mold as claimed in claim 6, wherein the alkyl poly-silicate is ethyl poly-silicate or isopropyl poly-silicate.

10. The binder composition for a mold as claimed in claim 6, wherein the amine is piperidine, benzylamine, dibutylamine, morpholine, ethanolamine, N-methylethanolamine, dimethylethanolamine, aminoethylethanolamine, aminoethyldiethanolamine, diethyleneethanoldiamine, diethanolamine, tert-butyleneglycolamine, triethanolamine, γ-(2-aminoethyl)aminopropyltrimethoxysilane, γ-aminopropyltriethoxysilane or bis [3-(triethoxysilyl)propyl]amine.

11. The binder composition for a mold as claimed in claim 6, wherein the alkoxide of Ti, Zr, Sn, Al or In is propoxide or butoxide of the metal.

12. A binder composition for making a ceramic shell mold for an extremely precise investment casting of metals by forming a layer containing said binder and a refractory material on and in contact with a water soluble urea pattern, drying said layer in air during which said binder is hardened through absorption of water from the air and evaporation of solvent in the binder, removing said pattern from said layer by dissolving the pattern with water, again drying said layer, and finally firing said layer, comprising a uniform mixture of (a) 5–50 parts by weight as $SiO_2$ of an organo-silica sol which contains not more than 1% by weight of water and consists essentially of 5–60% by weight based on said sol of colloidal silica having a particle size of 5–100 mμ and residual amounts of an organic solvent selected from a group consisting of aliphatic and aromatic hydrocarbons having 6–8 carbon atoms in the molecule, aliphatic monohydric alcohols having 3–6 carbon atoms in the molecule and mixtures thereof, (b) 1–30 parts by weight of an alkyl-trialkoxysilane, wherein the alkoxy group and the alkyl group each have 1–4 carbon atoms; and the alkyl group has at least one amino group.

13. The binder composition for a mold as claimed in claim 12, wherein the organic solvent in the organo-silica sol is hexane, heptane, benzene, xylene, toluene, propanol, butanol or a uniform solution thereof.

14. The binder composition for a mold as claimed in claim 12, wherein the alkyl-trialkoxysilane is γ-(2-aminoethyl)-aminopropyltrimethoxysilane, γ-aminopropyltriethoxysilane or bis [3-(triethoxysilyl)propyl]amine.

15. A binder composition for making a ceramic shell mold for an extremely precise investment casting of metals by forming a layer containing said binder and a refractory material on and in contact with a water soluble urea pattern, drying said layer in air during which said binder is hardened through absorption of water from the air and evaporation of solvent in the binder, removing said pattern from said layer by dissolving the pattern with water, again drying said layer, and finally firing said layer, comprising a uniform mixture of (a) 5–50 parts by weight as $SiO_2$ of an organo-silica sol which contains not more than 1% by weight of water and consists essentially of 5–60% by weight based on said sol of colloidal silica having a particle size of 5–100 mμ and residual amounts of an organic solvent selected from a group consisting of aliphatic and aromatic hydrocarbons having 6–8 carbon atoms in the molecule, aliphatic monohydric alcohols having 3–6 carbon atoms in the molecule and mixtures thereof, (b) 1–30 parts by weight of an alkyl trialkoxysilane wherein the alkoxy group and the alkyl group each have 1–4 carbon atoms, and the alkyl group has at least one amino group, and (c) 1–30 parts by weight of a tetra-alkoxide of Ti, Zr, or Sn or a tri-alkoxide of Al or In, wherein the alkoxy group has 1–4 carbon atoms, or a mixture thereof.

16. The binder composition for a mold as claimed in claim 15, wherein the organic solvent in the organo-silica sol is hexane, heptane, benzene, xylene, toluene, propanol, butanol or a uniform solution thereof.

17. The binder composition for a mold as claimed in claim 15, wherein the alkyl-trialkoxysilane is γ-(2-aminoethyl)-aminopropyltrimethoxysilane, γ-aminopropyltriethoxysilane or bis-[3-(triethoxysilyl)propyl]amine.

18. The binder composition for a mold as claimed in claim 15, wherein the alkoxide of Ti, Zr, Sn, Al or In is propoxide or butoxide of the metal.

* * * * *